United States Patent [19]

Forry et al.

[11] Patent Number: 4,585,685

[45] Date of Patent: Apr. 29, 1986

[54] ACOUSTICALLY POROUS BUILDING MATERIALS

[75] Inventors: John S. Forry, Manor Township, Lancaster County; Karl B. Himmelberger, Lancaster, both of Pa.

[73] Assignee: Armstrong World Industries, Inc., Lancaster, Pa.

[21] Appl. No.: 690,990

[22] Filed: Jan. 14, 1985

[51] Int. Cl.[4] ..... B32B 17/06; B32B 19/04; B32B 31/14; E04B 1/82

[52] U.S. Cl. ..... 428/143; 428/150; 428/171; 428/206; 428/283; 156/62.8; 181/284; 181/290

[58] Field of Search ..... 428/49, 143, 150, 170, 428/171, 173, 206, 283, 287; 181/284, 290, 294; 156/62.8, 62.4

[56] References Cited

U.S. PATENT DOCUMENTS

| | | | |
|---|---|---|---|
| 3,357,516 | 12/1967 | Cadotte et al. | 181/290 |
| 3,963,847 | 6/1976 | Norgard | 428/147 |
| 4,476,175 | 10/1984 | Forry et al. | 428/170 |

*Primary Examiner*—John E. Kittle
*Assistant Examiner*—Thomas C. Saitta
*Attorney, Agent, or Firm*—Laird F. Miller

[57] ABSTRACT

The present invention relates to acoustically porous building materials which are produced by disposing an aggregate material on the surface of a dry-formed web comprising a fibrous material and an organic binder, and consolidating the composite material such that the aggregate material is embedded in the web. The resulting product is acoustically porous but, in one preferred embodiment, the embedding process provides a substantially planar surface which is relatively non-friable.

46 Claims, 11 Drawing Figures

PRIOR ART

ACOUSTICALLY POROUS BUILDING MATERIALS

The present invention relates to building materials, and more particularly to building materials which are acoustically porous.

BACKGROUND OF THE INVENTION

Acoustical building materials are widely used to control noise levels and reverberation in many different types of environments. Materials having a porous face are most commonly used to provide sound absorption. Sound enters through the face of the porous material and, as air moves back and forth within the material, the sound energy is converted into heat by friction. Conventionally, such acoustical material has been produced by wet-laying processes using slurries of suspended materials. The resulting products, however, have suffered from a variety of drawbacks. Specifically, because they are wet-laid, the fibers are closely packed so that sound cannot readily penetrate the board; thus, a wet-laid board must be perforated or fissured in order to obtain acceptable acoustical performance. In addition, excessive energy usage results from the drying of wet-laid board products. For these reasons, much recent interest has related to acoustical boards which are produced by dry-forming procedures.

THE PRIOR ART

Wet-forming procedures for producing acoustical board are well known in the art. For example, U.S. Pat. Nos. 2,968,327, 2,995,198, 3,223,580, 3,286,784 and 3,779,862, all of which are owned by the assignee of the present invention, relate to various wet-forming techniques and wet-formed products which are used as acoustical materials. As indicated above, these materials typically provide acoustical control through the use of perforations or fissures. In addition, these materials have also been used in combination with fabric facing materials which are perforated.

Aggregate facing materials have not been successfully used to produce acoustical materials because the facing materials cannot be adequately adhered to the board when it is in the wet state. This may occur because the consolidation which causes the aggregate to adhere to the wet board results in a densification of the board so that it is no longer acoustical, and/or because the faced boards cannot be fissured to render them acoustically porous without substantially interfering with the appearance of the board. When aggregate is adhered to a dry board, after the board has assumed a fairly rigid structure, a number of problems also have been encountered. For example, uneven surfaces have been produced, the acoustic performance has been reduced because the adhesive used to adhere the particles has blocked access to the interior of the board, and the adhered particles have been friable and subject to abrasion. Abrasion causes the surfacing material to flake and peel, and the results have been generally unacceptable from an aesthetic and a performance point of view. A typical prior art board is illustrated in the drawings where 10 is a dried and punched wet-laid board containing fissures 13. The aggregate particles 12 are held to board 10 by adhesive layer 11.

Some recently produced dry-formed products have shown promise as acoustical materials. For example, U.S. Pat. Nos. 4,097,209 and 4,146,564 describe mineral wool fiberboard products. However, because of gauge control problems, these products had to be thickly constructed and they were typically faced with a woven material in order to provide adequate aesthetic appeal.

Among the most recent advances in dry-forming techniques are those which are disclosed in U.S. Pat. Nos. 4,432,714, 4,435,353, and 4,476,175. These references disclose dry-forming apparatus, processes for using the apparatus, and specialized products which can be produced. Preferably the products comprise webs of mineral wool and binder, optionally in combination with a perlite core material. The resulting structures, however, do not have a pleasing appearance and require painting and the like in order to be aesthetically acceptable.

Accordingly, one object of the present invention is to provide a dry-formed product which has a facing having a pleasing appearance, yet which is acoustically porous.

Another object of the present invention is to provide building materials which are faced with an aggregate material that is relatively non-friable while also exhibiting a pleasing appearance.

These and other objectives of the present invention will become apparent from the detailed description of preferred embodiments which follow.

BRIEF DESCRIPTION OF THE DRAWINGS

The Prior Art represents a wet formed board to which is adhered a perlite surfacing material.

SUMMARY OF THE INVENTION

Figure 1:
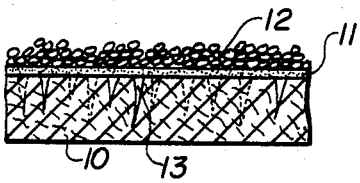
FIG. 1 represents a dry formed web on which is distributed aggregate material.
Figure 1:
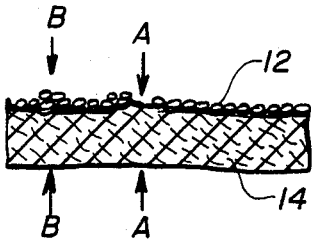

The present invention relates to acoustically porous building materials which are produced by disposing an aggregate material on the surface of a dry-formed web comprising a fibrous material and an organic binder, and consolidating the composite material such that the aggregate material is embedded in the web. The resulting product is acoustically porous but, in one preferred embodiment, the embedding process provides a substantially planar surface which is relatively non-friable.

DETAILED DESCRIPTION OF PREFERRED EMBODIMENTS

In one embodiment, the present invention relates to a process for preparing an acoustically porous composite, said process comprising the steps of providing a dry-formed web comprising substantially fibrous material and organic binder; interfacing a layer of aggregate material with said web such that the majority of said particles are in contact with said web, the compressibility of said aggregate material relative to the compressibility of said web being such that said aggregate can be embedded in said web; and consolidating and curing the layered composite, whereby substantially all of said aggregate material is at least partially embedded in said web, the surface of the cured structure possesses the contour of the consolidation means and the cured structure is acoustically porous.

In a second embodiment, the present invention relates to a process for preparing an acoustically porous composite, said process comprising the steps of providing a dry-formed web comprising substantially fibrous material and organic binder; interfacing a layer of a surfacing mixture comprising an aggregate material and an organic binder with said web, the compressibility of said web being such that said aggregate can be embedded in said web; and consolidating and curing the layered composite, whereby said aggregate material adjacent said web is at least partially embedded therein, the surface of the cured structure possesses the contour of the consolidation means, and the cured structure is acoustically porous.

In a third embodiment, the present invention relates to an acoustically porous composite comprising an aggregate surfacing material on a dry-formed web comprising substantially fibrous material and organic binder, said web having the majority of said aggregate material at least partially embedded therein, the surface of said composite possessing the contour of the means used to effect consolidation.

In a fourth embodiment, the present invention relates to a consolidated acoustically porous composite comprising a surfacing material comprising a mixture of aggregate material and an organic binder on a dry-formed web comprising substantially fibrous material and organic binder, said web having the aggregate material adjacent thereto at least partially embedded therein, the surface of said composite possessing the contour of the means used to effect consolidation.

The present invention may be practiced by preparing a substantially fibrous material in the form of a web whereby the fibrous material is intermixed with an organic binder. The preferred fibrous material is mineral wool, also referred to as rock wool; however, other fibrous materials will also be useful. For example, glass or ceramic fibers may be used to advantage, as can organic fibrous materials such as carbon fiber, polyester fiber, aramid fiber, celluosic fiber, acrylic fiber, modacrylic fiber, and the like. Preferably, the web will be prepared such that the organic binder is intimately mixed with the fibrous material. Examples of organic binders which may be used to advantage are starch (both free flowing and pre-gelled), melamine-formaldehyde resins, phenolic resins, urea-formaldehyde resins, epoxy resins, polyester resins and the like. Thermoplastic resins may also be used although they are less preferred.

The web comprising the binder and fibrous material may be dry-formed by substantially any means selected by the artisan. The object will be to provide a web in which the fibrous material and organic binder are well intermixed, but in which the web is sufficiently resilient that the aggregate material can be embedded therein. Although the web can be prepared using mechanical means, preferably it will be aerodynamically formed, and most preferably it will be aerodynamically formed using apparatus such as that disclosed in U.S. Pat. No. 4,432,714. When such apparatus is used, the thickness of the web, as well as its composition, can be controlled with great accuracy, especially where mineral wool is used as the fibrous material.

Alternatively, webs may be formed directly as part of the fiber-forming process using procedures which are well known in the art. For example, where glass fibers are used, Applicants are aware that specialized apparatus is available to form batts of glass fiber and binder which have varying thicknesses. For purposes of the present invention, such webs will be considered as "dry-formed." Accordingly, it may be to the advantage of the artisan to purchase pre-formed webs of material rather than to prepare them as disclosed herein. It will also be understood that the web per se may be used, or it may be a part of a more complex structure in which the web comprises the facing. The choice will be largely at the discretion of the artisan.

The aggregate which may be used as the surfacing layer may comprise substantially any particulate material which is recognized as being useful to produce building materials. Examples are perlite, expanded perlite, vermiculite, silica sand, talc, particulate glass, crushed stone, marble chips, and wood chips, among others. Of course, as the percent open area and the porosity of the aggregate particles decrease, the more reflection of sound can occur. Therefore, materials such as perlite, expanded perlite, and vermiculite are preferred.

In one preferred embodiment, only enough aggregate will be provided to cover the surface of the web so that, when consolidated, sufficient space will remain between the aggregate particles to permit sound to pass into the web. Most preferably, a monolayer of aggregate will be provided but it is essentially impossible to obtain monolayer coverage, especially where the dry-formed web has a fairly irregular surface.

An example of a typical preferred deposition is illustrated in FIG. 1 in which approximately a single layer of particles 12 resides on the mineral wool/binder web 14. While monolayer coverage is desirable, certain regions such as view A—A of FIG. 1 may have no coverage whereas other regions such as view B—B may have excess coverage. Accordingly, although an ideal particle distribution presumably cannot be obtained, the objective will be to provide sufficient aggregate to give an aesthetically pleasing product without unduly restricting the passage of sound through the aggregate, and without providing an irregular surface that would tend to be friable.

Once the aggregate is disposed on the web, a further objective is to densify the combined materials under pressure using conditions which will cause curing of the binder. When properly consolidated, the aggregate adjacent the web will be at least partially embedded in the web so as to be firmly held in place when curing is complete. In addition, the aggregate will be embedded such that the outer surface is relatively planar and fairly smooth. That is to say, the compressibility of the underlying web permits protruding particles of aggregate to be pushed into the web such that the tops of the aggregate particles are substantially in the same plane. It will not be possible to obtain a perfectly smooth surface because of the character of the aggregate; however, the multi-level, rough, irregular surface texture of aggregate-faced prior-art boards (e.g., perlite-faced wet-formed boards), and the accompanying friability, will be substantially avoided. It will be recognized, of course, that the surface may also be embossed. Thus, planarity as used herein is intended to refer to the plane of the tops of the aggregate particles, and not necessarily to a plane which is at or parallel to the board surface.

In order for the aggregate material to be embedded in the fibrous material, the web must be resilient enough that it can deflect so as to permit the aggregate to be forced into the web surface and at least partially surrounded by the web constituents. Thus, when the consolidation and curing process is complete, the aggregate material will be firmly adhered to the web. Nevertheless, because the aggregate material will have pore spaces between the particles through which air can pass, and because the web will retain openings between the fibers, the resulting composite material will remain acoustically porous.

Figure 2:
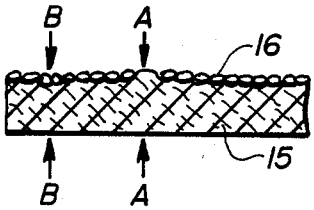
FIG. 2 represents a structure resulting from the consolidation of FIG. 1.
Figure 3:
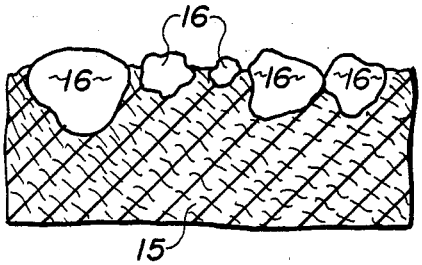
FIG. 3 represents an enlarged view of aggregate particles embedded in a dry formed web.

An illustration of the embedded particles is shown in FIG. 2, which represents the product resulting from the consolidation of the composite shown in FIG. 1. The embedded particles 16 are partially surrounded by the consolidated web 15. As indicated by views A—A of FIGS. 1 and 2, in regions where no aggregate resided on web 14, consolidated web 15 comprises that portion of the board surface. Views B—B, where excess particles reside, show that at least some of these particles are deeply embedded in the web. An enlarged view of aggregate particles of different sizes embedded in a web is shown in FIG. 3.

Figure 4:
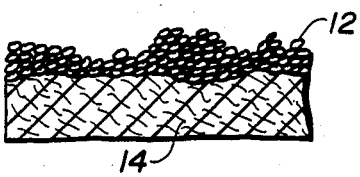
FIG. 4 represents a dry formed web on which is disposed excess aggregate material.
Figure 5:
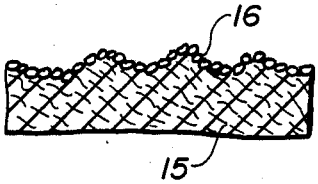
FIG. 5 represents the structure resulting from the consolidation of FIG. 4 and the subsequent removal of excess aggregate.

It may also be desirable to apply more than a monolayer of aggregate to the surface of the web, as illustrated by FIGS. 4 and 5. If the aggregate does not contain an additional binder, the particles which are not embedded in consolidated web 15 will not be held in place and they will fall off. The resulting product will then have an irregular surface as illustrated in FIG. 5. While such a surface may be desired in some circumstances, it will be more subject to abrasion damage because of the irregular surface texture.

Figure 6:
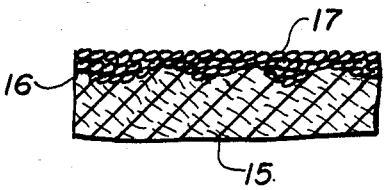
FIG. 6 represents the structure resulting from the consolidation of a composite comparable to that described in FIG. 4 wherein the aggregate is mixed with binder.

Excess aggregate may nevertheless be applied so as to provide a relatively non-friable surface if a binder, such as those disclosed above, is included with the aggregate. An example of a product which may be obtained is illustrated in FIG. 6. Embedded particles 16 are held in the usual manner by consolidated web 15, but bound particles 17 are affixed to each other and to embedded particles 16 by the included binder. Nevertheless, the aggregate layer will retain the pore spaces which permit sound to enter the board and the resulting product will remain acoustically porous.

Figure 7:
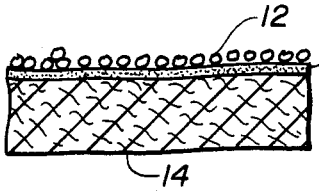
FIG. 7 represents a structure comparable to that illustrated in FIG. 1 wherein a layer of adhesive is disposed between the aggregate and the web.

As yet another option, a coating of liquid binder may be thinly applied to the web, such as by spatter coating, so as to enhance the attachment of the aggregate particles and, if desired, to provide background color. An example of such an application is shown in FIG. 7 wherein the binder is represented by layer 18. It is noted, however, that care must be taken to avoid excess application of the binder so that access to the fibrous web by the sound waves will not be prevented. As an added consideration, aggregate may be selectively applied to a web, either with or without the use of adhesive, so as to provide a patterned effect.

Consolidation may be achieved using a through-convection dryer (TCD) equipped with an upper pressure conveyor belt; a flat bed press; or a press which uses an embossing plate varying in design. Because the web surface can be deformed in response to the nature of the pressure applied, the result is, in the absence of a design pattern, a substantially flat, planar finish which is substantially non-friable. When a design is used, however, essentially the same result is achieved although the surface is contoured. This result is distinguishable from prior art boards surfaced with the same facing aggregate wherein the support surface for the facing material could not be deformed, and the resulting surface was highly irregular. Under such circumstances, the particulate facing material was readily abradable.

Figure 8:
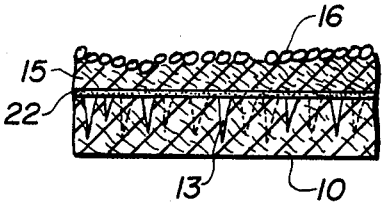
FIG. 8 represents a structure wherein a consolidated web as in FIG. 2 is adhered to a prior art wet-laid board.

The advantages of the products formed according to the above procedure are evident. If relatively thin structures are provided, the consolidated material may be rolled and stored for future use or it may be adhered to a support structure which possesses acoustical absorption characteristics. For example, a conventional wet-laid board can be dried, provided with perforatations or fissures, and then adhered to a composite of the present invention. In such a circumstance, the object will be to provide a final composite structure which has acoustical performance that is about the same as that of the underlying support structure, but which has a decorative facing. An example of such a structure is illustrated in FIG. 8 wherein 22 represents the adhesive which adheres consolidated web 15 to board 10. Of course, as explained above, it will be recognized that adhesive 22 should be applied such that it does not substantially interfere with access by the sound waves to fissures 13.

Figure 9:
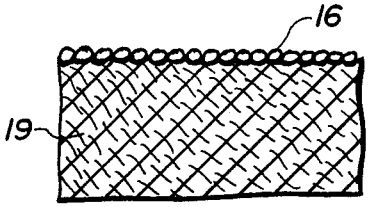
FIG. 9 represents a structure in which an aggregate material is adhered to a relatively thick batt of fibrous material.

Conversely, a web of the present invention could be formed in a relatively thick manner such that the panels themselves will have use as building materials. This is illustrated in FIG. 9 where web 19 is of thick gauge.

Figure 10:
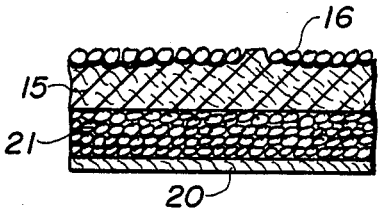
FIG. 10 represents a structure comprising a substantial monolayer of aggregate, a fibrous web, a perlite core, and a bottom fibrous web.
Figure 11:
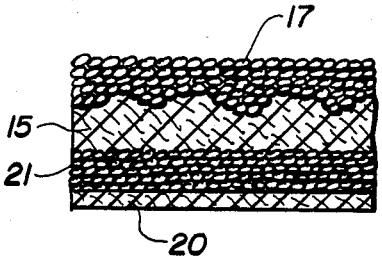
FIG. 11 represents a structure comprising an aggregate/binder surfacing material, an underlying fibrous web, a perlite core material, and a supporting fibrous web.

Another preferred structure is illustrated in FIG. 10 which represents aggregate 16 embedded in a structure which was produced according to Example VI of U.S. Pat. No. 4,476,175. Consolidated web 15 is adhered to a core material 21 comprising expanded perlite and binder, and the core is adhered to a backing web comprising mineral wool and binder. Because the structure comprises primarily inorganic material, it is fire resistant and acoustically porous; nevertheless, it has a pleasing appearance. FIG. 11 illustrates a similar structure which comprises an aggregate/binder facing comparable to that illustrated in FIG. 6.

The acoustical performance of porous structures may be evaluated in a variety of ways. One measure of acoustical performance is through the determination of noise reduction coefficient (NRC) values at a number of different frequencies and then averaging the values. A procedure for making such determinations is set forth in ASTM C 423-84a. Typicaly, a composite structure of the present invention would be considered to be acoustically performing (i.e., it is an acoustically porous material) if it has an NRC value of 0.40 or greater.

Another way of estimating the acoustical performance of such structures is by measuring the ability of an acoustical panel to resist air flow. If the flow resistance of a material were infinite, there would be no absorption and the sound would be reflected. Conversely, if there were no resistance to the passage of air, the sound would pass through unchanged and there would be no conversion of the sound to heat. Accordingly, the resistance to air passage can provide an estimate of a board's ability to perform acoustically. ASTM C 522-80 describes a procedure which may be followed to make such measurements. In general, if an unfaced board has a defined air flow resistance and the board, when faced with a decorative material, has approximately the same air flow resistance, the NRC values for the faced and the unfaced boards will be about the same.

For purposes of the present invention, it is desirable to provide an acoustical material with an embedded aggregate surface such that the air flow resistance of the product in relation to the starting acoustical material will be about the same, provided that the respective air flow resistances are normalized to a per-unit-thickness basis. If the normalized resistance of the composite is the same as that of the starting material (or less), the same acoustical performance (or better) will be obtained.

It will also be apparent to one skilled in the art, however, that the adherence of aggregate faced webs to substrates having different air flow resistances may provide products which perform differently, yet which are still acoustically porous. Thus, if the same facing is provided for two acoustically porous substrates, one having an NRC of 0.50 (and a relatively higher air flow resistance) and the other an NRC of 0.90 (and a relatively low air flow resistance), an increase in the normalized air flow resistance might be found for each, but the increase might be more pronounced for the substrate which had the initially high NRC. For example, an increase of 10% in the normalized air flow resistance might be found for the former substrate whereas an increase of 150% might be found for the latter. Nevertheless, if properly constructed, each would still possess properties indicating that they were acoustically porous, i.e., they would have NRC value of not less than 0.40. Accordingly, the artisan may desire to laminate a facing of the present invention to a variety of substrates having either low or high air flow resistances, provided that a composite is obtained which is still acoustically porous.

Further understanding of the present invention and further advantages to be obtained from practicing the present invention will be apparent from the examples which follow, the examples being presented by way of illustration and not limitation.

EXAMPLES

In the examples which follow, air flow resistance measurements were made using modified equipment comparable to that disclosed by R. W. Leonard in The Journal of the Acoustical Society of America, 17, 240 (1946). Measurements were made in cgs Rayls and were normalized to a standard one-inch thickness. Although the test procedure differed from that disclosed in ASTM C 522-80, the relative flow-resistance results for the samples would be correlatable with results obtained according to the ASTM test.

EXAMPLE 1

This example will illustrate the acoustical performance of a perlite faced prior art board. A wetlaid board was prepared by means known in the art using a fourdrinier apparatus. While the dewatered sheet resided on the wire, a dry layer of perlite was applied, the layered sheet was passed through the press section, and the consolidated sheet was separated from the wire. The sheet was then dried in a conventional manner by passing it through a heating tunnel. Although the board had a pleasing appearance, its NRC essentially according to ASTM C 423 was 0.28 and its air flow resistance, measured as described above, was 6436 cgs Rayls per inch. This acoustical performance was unacceptable and the perlite facing was readily friable.

EXAMPLE 2

This example will illustrate the production of a perlite-faced mineral wool sheet. An uncured and unconsolidated web comprising 87% mineral wool and 13% powdered phenolic binder was produced essentially according to the process described in Example I of U.S. Pat. No. 4,476,175. The web had a basis weight of 55 grams per square foot and a density of about 4.5 to 5 pounds per cubic foot.

A layer of expanded perlite was applied to the surface of the mat using a volumetric metering device comprising a supply hopper mounted over a running belt with a front-end gate capable of controlling the height of the applied perlite. The volume was adjusted such that the thickness of the layer of perlite was approximately the thickness of the largest perlite particle, ca. 6 mesh (U.S. Standard). Because of the thin layer of applied perlite, the underlying fibrous web was visible through certain portions of the perlite layer. The structure appeared as shown in FIG. 1.

The layered structure was conveyed into a flatbed press preheated to 450° F. and compressed for about 45 seconds to yield a product having a thickness of about 0.180 inch and a density of about 18 pounds per cubic foot. This product showed an air flow resistance of 500 cgs Rayls/inch, thus indicating that it was acoustically porous.

EXAMPLE 3

This example will illustrate the preparation of a laminated material comprising a mineral wool/perlite facing. A commercial wet-laid fiberboard product approximately ½-inch thick was spatter coated with a polyvinyl acetate adhesive at a level of ca. 10 grams per square foot. The perlite-faced mat of Example 2 was applied to the board and consolidated under 10 pounds pressure for 30 seconds. The resulting product showed an air flow resistance of 3019 cgs Rayls/inch compared to a resistance of 3675 cgs Rayls/inch for the baseboard, thus indicating that the NRC of the laminate would be unchanged or would exceed the NRC of the baseboard.

EXAMPLE 4

This example will illustrate the preparation of a product comprising a vermiculite facing. Following the procedure described in Example 2, a mat was produced having a basis weight of 454 grams per square foot. To the web of material was applied a uniform layer of vermiculite using the volumetric applicaton apparatus referred to in Example 2. The layered material was then conveyed into a flatbed press preheated to 450° F. and consolidated for 10 minutes to a thickness of ca. 1-inch. The resulting board was provided with a finish paint coat and demonstrated an air flow resistance of 155 cgs Rayls/inch. The press time was substantially longer than that used in Example 2. Thus, it will be noted that the press time can vary depending on the resin which is used, the type of curing apparatus, and the thickness of the material.

EXAMPLE 5

This example will illustrate the preparation of a different type of acoustically porous material using glass batting and sand aggregate. A commercially prepared glass batt containing liquid phenolic resin was purchased from Manville Corporation, the batting having a thickness 1.5 to 2 inches and a basis weight of about 50 grams per square foot. Sand was applied to the batting in the previously described manner; however, because the batt had a variable surface terrain (due to its varying thickness) and because sand is a dense material, the sand tended to flow into the low spots, leaving large uncovered areas of surface.

To avoid this problem, a uniform thin layer of sand was applied to a release paper and the batt was then interfaced with the sand. The layered materials were conveyed to a flatbed press preheated to 450° F. and cured after being compressed to a thickness of ca. ⅛-inch. When removed from the press and separated from the release paper, the consolidated materials were inverted to provide a sand-surfaced product having an air flow resistance of 805 cgs Rayls/inch.

EXAMPLE 6

This example will illustrate the production of a sample having an increased resistance to surface friability. A mineral wool mat as described in Example 2 was prepared and provided with an aggregate coating comprising an 87% perlite and 13% powdered starch binder. The layered material was provided with sufficient water to permit the starch to gel in the press and it was then subjected to the curing process of Example 2. The resulting product, corresponding to FIG. 6, showed a relatively increased resistance to surface abrasion damage when subjected to hand rubbing because the surface was quite planar and the starch caused the aggregate particles to adhere to one another.

EXAMPLE 7

This example will illustrate the use of an adhesive layer between the surface aggregate and the underlying fibrous surface. A mineral wool mat was provided as described in Example 2. To the uncured and unconsolidated web was applied a pigmented adhesive formula having the following composition:

| Component | Percent by Weight |
|---|---|
| Hexamethylenetetramine | 4.3 |
| Polyvinylalcohol | 18.0 |
| Kaolinite clay slurry (70% solids) | 77.7 |

The adhesive was applied by spraying at a rate of 24 grams per square foot. To the surface of this material was applied a layer of perlite as described in Example 2 to give a structure corresponding to that shown in FIG. 7. The resulting product was then consolidated to give a product which had the appearance of that illustrated in FIG. 2, except that the pigmented adhesive was visible through the spaces between the particles.

The product showed an air flow resistance of 528 cgs Rayls/inch. These results indicate that the application of the adhesive only slightly affected the air flow through the mat; however, the coating also served to hide the underlying mineral wool mat and provided a pleasing appearance to the product.

EXAMPLE 8

This example will illustrate the preparation of a perlite/binder cored product having a perlite facing. The cored substrate was prepared essentially as described in Example VI of U.S. Pat. No. 4,476,175 except that, prior to transferring the consolidated cored material to the TCD oven, adhesive was sprayed on the top surface of the web. The adhesive and the rate of application were the same as that disclosed in Example 7 and the perlite was similarly applied. The layered composite was cured as described in the referenced Example VI to give a product having a pleasing appearance, a substantially non-friable surface, and a thickness of 0.51 inch. The NRC of this product, measured essentially according to ASTM C 423, was 0.55 and the air flow resistance was 947 cgs Rayls/inch.

By way of comparison, the NRC of the board prepared as described in Example VI of U.S. Pat. No. 4,476,175 was 0.60 and its air flow resistance was 710 cgs Rayls/inch. The thickness of the board was 0.49 inch and its appearance was unsatisfactory for use as a conventional ceiling. Thus, although the NRC decreased slightly and the air flow resistance increased slightly for the perlite faced product of the present invention, that product nevertheless had good acoustical performance and a superior appearance.

The present invention is not restricted solely to the descriptions and illustrations provided above but encompasses all modifications envisaged by the following claims.

What is claimed is:

1. A process for preparing an acoustically porous composite, said process comprising the steps of:

providing a dry-formed web comprising substantially fibrous material and organic binder;

interfacing a layer of aggregate material with said web such that the majority of said particles are in contact with said web, the compressibility of said aggregate material relative to the compressibility of said web being such that said aggregate can be embedded in said web; and consolidating and curing the layered composite, whereby substantially all of said aggregate material is at least partially embedded in said web, the surface of the cured structure possesses the contour of the consolidation means, and the cured structure is acoustically porous.

2. The invention as set forth in claim 1 hereof wherein said aggregate comprises perlite.

3. The invention as set forth in claim 1 hereof wherein said aggregate comprises vermiculite.

4. The invention as set forth in claim 1 hereof wherein said aggregate comprises sand.

5. The invention as set forth in claim 1 hereof wherein said fibrous material comprises mineral wool.

6. The invention as set forth in claim 1 hereof where said fibrous material comprises fiberglass.

7. The invention as set forth in claim 1 hereof wherein said aggregate comprises an organic binder.

8. The invention as set forth in claim 1 hereof wherein said aggregate is selectively applied to said web to provide a patterned appearance.

9. The invention as set forth in claim 1 hereof wherein said process comprises the additional step of interposing a substantially non-acoustically interfering layer of binder between said aggregate and said web.

10. The invention as set forth in claim 9 hereof wherein said aggregate is selectively applied to said binder coated web to provide a patterned appearance.

11. The invention as set forth in claim 1 hereof wherein said process comprises the additional step of adhering said consolidated and cured composite to a dry acoustically porous wet-laid board.

12. The invention as set forth in claim 1 hereof wherein said web comprises an underlying core material comprising expanded perlite and organic binder, and a supporting dry-formed backing web.

13. A process for preparing an acoustically porous composite, said process comprising the steps of:

providing a dry-formed web comprising substantially fibrous material and organic binder;

interfacing a layer of a surfacing mixture comprising an aggregate material and an organic binder with said web, the compressibility of said web being such that said aggregate can be embedded therein; and consolidating and curing the layered composite, whereby said aggregate material adjacent said web is at least partially embedded therein, the surface of the cured structure possesses the contour of the consolidation means, and the cured structure is acoustically porous.

14. The invention as set forth in claim 13 hereof wherein said aggregate comprises perlite.

15. The invention as set forth in claim 13 hereof wherein said aggregate comprises vermiculite.

16. The invention as set forth in claim 13 hereof wherein said aggregate comprises sand.

17. The invention as set forth in claim 13 hereof wherein said fibrous material comprises mineral wool.

18. The invention as set forth in claim 13 hereof wherein said fibrous material comprises fiberglass.

19. The invention as set forth in claim 13 hereof wherein said aggregate is selectively applied to said web to provide a patterned appearance.

20. The invention as set forth in claim 13 hereof wherein said composite comprises a substantially non-acoustically interfering layer of binder between said aggregate and said web.

21. The invention as set forth in claim 20 hereof wherein said aggregate is selectively applied to said binder coated web to provide a patterned appearance.

22. The invention as set forth in claim 13 hereof wherein said web comprises an underlying core material comprising expanded perlite and organic binder, and a supporting dry-formed backing web.

23. The invention as set forth in claim 13 hereof wherein said process comprises the additional step of adhering said consolidated and cured composite to dry acoustically porous wet-laid board.

24. An acoustically porous composite comprising an aggregate surfacing material on a dry-formed web comprising substantially fibrous material and organic binder, said web having the majority of said aggregate material at least partially embedded therein, the surface of said composite possessing the contour of the means used to effect consolidation.

25. The invention as set forth in claim 24 hereof wherein said aggregate comprises perlite.

26. The invention as set forth in claim 24 hereof wherein said aggregate comprises vermiculite.

27. The invention as set forth in claim 24 hereof wherein said aggregate comprises sand.

28. The invention as set forth in claim 24 hereof wherein said fibrous material comprises mineral wool.

29. The invention as set forth in claim 24 hereof wherein said fibrous material comprises fiberglass.

30. The invention as set forth in claim 24 hereof wherein said aggregate comprises an organic binder.

31. The invention as set forth in claim 24 hereof wherein selectively applied aggregate provides a patterned appearance to said web.

32. The invention as set forth in claim 24 hereof wherein said composite comprises a substantially non-acoustically interfering layer of binder between said aggregate and said web.

33. The invention as set forth in claim 32 hereof wherein selectively applied aggregate provides a patterned appearance to said binder coated web.

34. The invention as set forth in claim 24 hereof wherein said composite comprises an underlying core material comprising expanded perlite and organic binder, and a supporting dry-formed backing web.

35. The invention as set forth in claim 24 hereof wherein said composite comprises an underlying dry acoustically porous wet-laid board.

36. A consolidated acoustically porous composite comprising a surfacing material comprising a mixture of aggregate material and an organic binder on a dry-formed web comprising a substantially fibrous material and organic binder, said web having the aggregate material adjacent thereto at least partially embedded therein, the surface of said composite possessing the contour of the means used to effect consolidation.

37. The invention as set forth in claim 36 hereof wherein said aggregate comprises perlite.

38. The invention as set forth in claim 36 hereof wherein said aggregate comprises vermiculite.

39. The invention as set forth in claim 36 hereof wherein said aggregate comprises sand.

40. The invention as set forth in claim 36 hereof wherein said fibrous material comprises mineral wool.

41. The invention as set forth in claim 36 hereof wherein said fibrous material comprises fiberglass.

42. The invention as set forth in claim 36 hereof wherein selectively applied aggregate provides a patterned appearance to said web.

43. The invention as set forth in claim 36 hereof wherein said composite comprises a substantially non-acoustically interfering layer of binder between said aggregate and said web.

44. The invention as set forth in claim 43 hereof wherein selectively applied aggregate provides a patterned appearance to said binder coated web.

45. The invention as set forth in claim 36 hereof wherein said composite comprises an underlying core material comprising expanded perlite and organic binder, and a supporting dry-formed backing web.

46. The invention as set forth in claim 36 hereof wherein said composite comprises an underlying dry acoustically porous wet-laid board.

* * * * *